United States Patent [19]

Morrison

[11] 4,195,809

[45] Apr. 1, 1980

[54] SCREED BAR SUPPORT STAKE AND METHOD

[76] Inventor: Donald R. Morrison, 2109 Camp Green St., Charlotte, N.C. 28208

[21] Appl. No.: 935,931

[22] Filed: Aug. 23, 1978

[51] Int. Cl.[2] ..... E04C 5/12

[52] U.S. Cl. ..... 249/205; 52/105; 52/301; 52/365; 52/367; 52/371; 264/31; 404/15; 404/71; 404/119; 404/135; 404/136; 425/456

[58] Field of Search ..... 52/105, 301, 365, 367, 52/371; 249/205; 264/31; 404/15, 71, 119, 135, 136; 425/456

[56] References Cited

U.S. PATENT DOCUMENTS

| | | | |
|---|---|---|---|
| 1,910,247 | 5/1933 | Heltzel | 404/15 |
| 2,031,396 | 2/1936 | Voight | 404/15 |
| 2,154,966 | 4/1939 | Vanderveer | 404/15 |
| 2,867,041 | 1/1959 | McMillan | 52/367 |
| 3,390,500 | 7/1968 | Schumak | 52/365 |
| 4,030,873 | 6/1977 | Morrison | 425/456 |

*Primary Examiner*—Lester L. Lee
*Attorney, Agent, or Firm*—B. B. Olive

[57] ABSTRACT

A screed bar support stake and method are uniquely adapted to concrete screeding operations utilizing a vibratory-type screed. The stake is formed with means which allow it to be located after the concrete has been poured and is also adapted with means enabling the stake to be removed for reuse before the concrete hardens thus saving the cost of the stake. A mating drive member facilitates easy placement of the stake.

5 Claims, 4 Drawing Figures

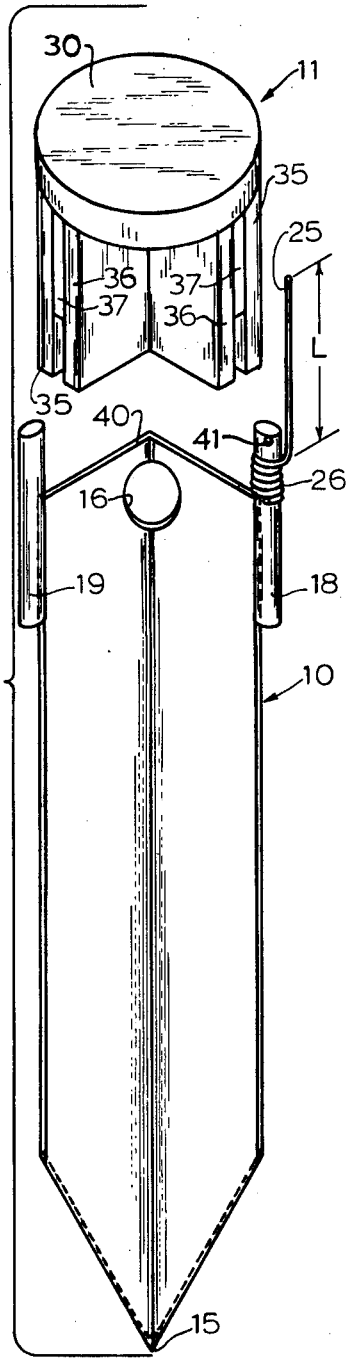
FIG. 1
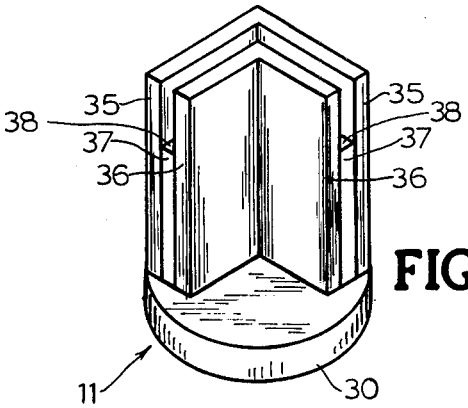
FIG. 2
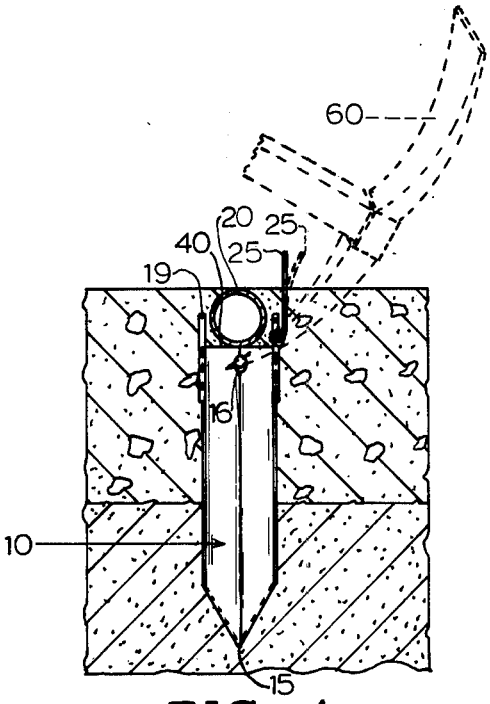
FIG. 4
FIG. 3
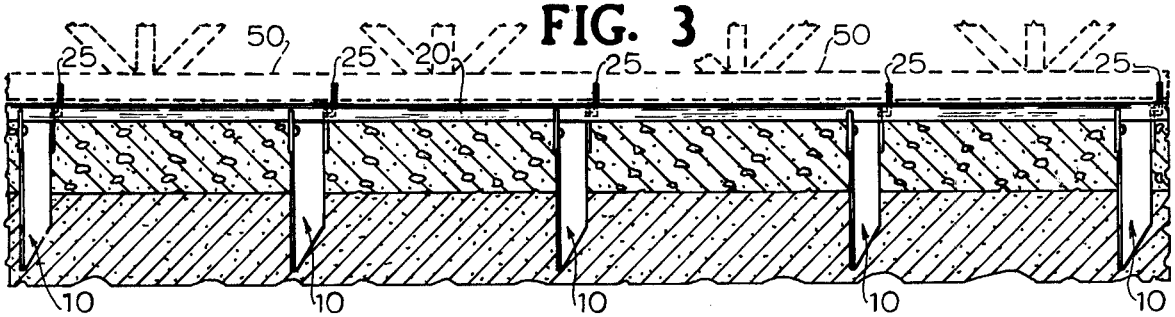

SCREED BAR SUPPORT STAKE AND METHOD

BACKGROUND OF THE INVENTION

1. Field of the Invention

The present invention relates to a screed bar support stake or chair as such stakes are sometimes referred to in the trade and to a method of using screed bar support stakes. The invention is more specifically directed to screed bar support stakes and methods of using such stakes with vibratory type screeds.

2. Description of the Prior Art

Screed bars are conventionally used when pouring concrete to obtain the proper grade or level. It has been customary to support the screed bar across the width of the work being screeded with stake devices. The stake is sometimes referred to as a "chair" in the trade. The screed bar is normally a metal pipe, or the like, and both metal and wooden stakes have been used to support the screed bar. The wooden stake has the disadvantage, if left in place after the concrete is poured, of rotting and eventually weakening the concrete. The metal stakes are often left in place which represents a large economic waste. In some instances, metal screed bar support stakes have been used which have been sufficiently long to provide an exposed portion after the concrete has been poured and which enables the stake to be located and also provides a means for pulling the stake out before the concrete fully hardens and after the screed bar is removed.

The type of metal stake heretofore used in the art with a rigid portion protruding above the concrete work is not satisfactory when using a vibratory screed such as shown in U.S. Pat. No. 4,030,873. For example, if a screed bar is placed in front of a vibratory screed and generally parallel to the longitudinal axis of the vibratory screed, it is desirable for the screed to be moved over the top of the screed bar and this, of course, could not take place if the screed bar support stakes are protruding above the surface of the concrete being poured. Also, when pouring extremely wide areas of concrete it has been the practice to use screed bars to support one end of the screed and in this case the screed bars extend perpendicular to the longitudinal axis of the vibratory screed. It can also be seen that in this application a screed bar stake having a protruding portion above the concrete surface is impractical for use with a vibratory-type screed.

Thus, in summary it would be desirable to have a type of screed bar support stake and method of using such stake which would allow a vibratory screed to pass over the stake and also would allow the stake to be located and removed for reuse before the concrete hardens and after the screed bar is removed.

SUMMARY OF THE INVENTION

The screed bar support stake and method is basically directed to utilization of a type of screed bar support stake and method of using such stake which allows the stake to be located and removed for reuse after the concrete has been poured. The screed bar support stake and method of the invention are also directed to a type of screen bar support stake which allows a vibratory screed to pass over the stake without damaging either the screed or the stake. The invention is also directed to forming the stake in a manner which allows a driver to be used to place the stake prior to pouring the concrete.

More specifically, the stake of the invention in the embodiment disclosed comprises a strip of angle iron having a pointed lower end and an upper end formed with an aperture and also with a pair of guide members adapted to loosely retain the screed bar and prevent lateral shifting while the screed bar rests on the stake. A particularly unique feature of the stake of the invention resides in employment of a small resilient wire member which extends above the stake proper and allows the stake to be located after the concrete has been poured. Due to the resilient nature of this locating wire, a vibratory-type screed can pass over the stake without damaging either the stake or the vibratory screed. The aperture serves the purpose of providing a means for a pick or other tool to grasp the stake and remove it before the concrete hardens thus enabling the stake to be reused.

The invention is also directed to employment of a drive member which can be loosely supported on top of the stake to provide a strike surface for a sledge hammer, or the like, to place the stake when the concrete work is initiated.

DESCRIPTION OF THE DRAWINGS

FIG. 1 is an exploded perspective view of a screed bar support stake and drive member according to the invention.

FIG. 2 is an inverted perspective view of the drive member.

FIG. 3 is a longitudinal section taken through a poured slab of concrete with the stakes of the invention in place.

FIG. 4 is an enlarged section view illustrating how the stake of the invention is removed.

DESCRIPTION OF THE PREFERRED EMBODIMENT

The screed bar support stake assembly of the invention comprises a stake member 10 and a drive member 11. Stake member 10 is formed from an angle iron strip having a pointed lower end 15, and an aperture 16 which provides a means for grasping stake 10 during removal, as later explained. A pair of rigid rod members 18, 19 are welded to the outer upper edge portions of stake 10 to support and retain the screed bar 20 which is illustrated in FIGS. 3 and 4 as being a metal pipe.

An important aspect of the invention resides in employment of a flexible, elongated member illustrated by the metal wire member 25 having a coiled section 26 wrapped on rod member 18. A stop 41 prevents detachment of coil 26 therefrom. The length L of wire member 25 is sufficiently long such that when stake 10 is properly positioned, the upper portion of wire member 25 will extend substantially above the screed bar 20, e.g., one to two inches, and thus provides a means for locating stake 10 after being embedded in the concrete and after screen bar 20 is removed. Also, significant to the invention is the fact that wire member 25 and the coiled mounting arrangement 26 enables the wire member 25 to be bent out of its normal vertical position, as illustrated in FIG. 4, and to spring back in place whenever struck by a vibratory-type screed or other smoothing device during the concrete pouring operation and before the screed bar 20 is removed.

The previously-mentioned drive member 11 comprises a heavy head portion 30 illustrated as a cylindrical metal block and which is welded or otherwise secured to a pair of spaced angle members 35, 36 between which is welded a shorter angle member 37 which provides a strike contact surface 38 with the top edge surface 40 of stake 10. Alternatively, angle members 35, 36 could be fabricated in a manner to provide a strike surface integral therewith. Thus, it can be seen that angle members 35, 36 are adapted to fit over the upper portion of stake 10 such that angle member 37 engages the top edge 40 of stake 10 to drive the stake into position in the ground when being installed prior to pouring of the concrete. It may also be noted that the dimensions of the drive member 11 are such as to allow it to be placed between the screed bar retaining rod members 18, 19.

As further indicated in FIG. 3, a plurality of the stakes 10 of the invention are placed in the usual manner to support the screed bar 20. It will be particularly noted in FIG. 3 illustrating this operation that the respective wire members 25 protrude above the surface of the concrete and thus provide a ready means for locating the various stakes 10 after the concrete has been poured and after the screed bar 20 has been removed. Also, of unique significance to the invention is the inherent ability of the exposed portions of wire members 25 to bend when struck during screeding by a vibratory screed as schematically indicated by numeral 50 in FIG. 3. That is, the uppermost exposed portions of wire members 25 protruding above the poured concrete can bend in place and return to their respective vertical identifying positions for spotting the hidden stake positions once the vibratory screed 50 has passed over the screed bar 20.

After the concrete has been poured and when it is still in a soupy wet condition, i.e., prior to becoming hard, the screed bar 20 is removed as in conventional practice. However, important to the invention, the implanted stakes 10 of the invention can also be readily located and readily removed from the wet concrete by observing the locations of the exposed portions of wire members 25 and by engaging the aperture 16 of each corresponding stake 10 with a suitable tool 60, such as a pick, as illustrated in FIG. 4. Once removed, the stake 10 can be immediately washed of any fresh concrete which makes it suitable for reuse at the next job. Also, once the screed bar 20 and the stakes 10 have been removed, finishing concrete may be poured into the recesses previously occupied by the screed bar 20 and stakes 10 which fills in the concrete and, thus, avoids any future weak spots or the like.

In summary, by utilizing the improved screed bar support stake and method of the invention, the improved stakes of the invention can be placed, the screed bar located, the concrete poured and and screeded with a vibratory-type screed or other screeding apparatus and during screeding the vibratory screed or other screeding apparatus can be moved over the tops of the implaced stakes 10 without damaging the stakes and without having to physically lift the screed to move over the top of the stakes. Further, the exposed portions of the respective wire members 25, can bend in place, be passed over by the vibratory screed during the pouring operation, then snap back to their vertical positions and after pouring has been completed provide a convenient means for locating each of the stakes 10 for removal and reuse as illustrated in FIG. 4. Thus, by the simple and practical stake construction and method of the invention, the concrete pouring industry is afforded a means for achieving very substantial savings and also for producing a higher quality work.

What is claimed is:

1. A screed bar support stake comprising: a formed metal stake having a pointed lower end, retention means at the upper end for supporting and retaining a screed bar thereon, an elongated flexible member extending vertically upwardly from said upper end and having an outer end portion terminating at a distance sufficiently remote from said upper end such that when said stake and a screed bar supported thereon are embedded in concrete the outer end of said flexible member provides a means protruding above said concrete for locating said stake.

2. A screed bar support stake according to claim 1 wherein said flexible member comprises a metal wire member having a straight upper portion and a coiled lower portion mounted on said upper end.

3. A screed bar support stake as claimed in claim 1 including grasping means formed on said stake enabling a withdrawal tool to be engaged thereto to remove said stake for reuse.

4. A screed bar support stake according to claim 3 wherein said stake includes a body portion of a metal angle strip and said grasping means consists of an aperture formed in the upper portion thereof.

5. A screed bar support stake according to claim 4 wherein said retention means consists of a pair of rigid rod members secured at the upper end portion of said metal stake.

* * * * *